United States Patent [19]

Kirkpatrick

[11] 4,377,974

[45] Mar. 29, 1983

[54] PRINTING BLANKET HOLDING BAR

[75] Inventor: A. D. Kirkpatrick, Morristown, N.J.

[73] Assignee: David M Company, Longwood, Fla.

[21] Appl. No.: 211,391

[22] Filed: Nov. 28, 1980

[51] Int. Cl.[3] ..... B41F 27/06

[52] U.S. Cl. ..... 101/378; 101/415.1

[58] Field of Search ..... 101/378, 415.1; 29/118, 29/120

[56] References Cited

U.S. PATENT DOCUMENTS

| | | | |
|---|---|---|---|
| 2,061,525 | 11/1936 | Storck | 29/118 |
| 2,123,997 | 7/1938 | Jironsek | 101/415.1 |
| 2,398,646 | 4/1946 | Karbach, Jr. et al. | 29/118 |
| 2,578,406 | 12/1951 | Dutro | 29/118 |
| 3,296,673 | 1/1967 | Kirkpatrick | 101/415.1 |
| 3,406,629 | 10/1968 | Hoexter | 101/415.1 |
| 4,090,444 | 5/1978 | Stearns | 101/378 |
| 4,217,825 | 8/1980 | Binckner | 101/415.1 |

*Primary Examiner*—William Pieprz

*Attorney, Agent, or Firm*—Nims, Howes, Collison & Isner

[57] ABSTRACT

A printing blanket holding bar adapted for insertion into a channel longitudinally extending along the periphery of a reel, the channel having a pair of flat, generally parallel side walls extending from the periphery of the reel, said holding bar comprising a base having a first flat surface and a second flat surface generally parallel therewith, each base surface adapted to be disposed against and cooperate with a corresponding channel side wall when said holding bar is operably inserted into the reel channel, a blanket clamping arm carried by said base and adapted to cooperate with said base to clamp an associated printing blanket end therebetween, a top surface of said clamping arm adapted to support the printing blanket when said holding bar is operably inserted into the reel channel and when the printing blanket is wrapped at least approximately one revolution around the reel, at least a substantial portion of said arm top surface being bowed, the tip of said arm tapering to substantially zero thickness, an edge of said arm top surface joining an edge of said base first surface, the edge of said base first surface which joins the edge of said arm top surface lying approximately even with the peripheral edge of its corresponding channel side wall when said holding bar is operably inserted into the reel channel.

3 Claims, 3 Drawing Figures

PRINTING BLANKET HOLDING BAR

BACKGROUND OF THE INVENTION

Printing presses, such as those used for offset or dry offset printing, employ printing blankets usually formed of a heavy textile fabric backing coated with rubber, or preferably several plies of alternating layers of fabric and rubber. The blanket is wrapped about the periphery of an associated printing cylinder to pick up an ink design or image deposited thereon by an inked printing roller or plate for transfer onto a sheet of paper or other article to be printed with the design. The cylinder about which the blanket is wrapped is usually provided with a longitudinal recess along its periphery into which the ends of the blanket may be inserted and releasably anchored to so-called reel rods or reels extending longitudinally along and within the recess.

Because the blanket wears out and must be replaced frequently, the means of anchoring the blanket ends to the reel rods should permit quick attachment and detachment of the blanket ends. Consequently, such anchoring means have been the subject of extensive research efforts. Some of the anchoring means developed as a result of this research are disclosed in U.S. Pat. Nos. 1,140,511; 1,670,418; 2,249,938; 2,712,789; 2,850,970; 2,986,085; 3,166,012; 3,260,200; 3,296,673; 3,332,346; 3,489,085; and 3,563,176. A recently devised means of anchoring the blanket ends that has achieved a significant amount of commercial acceptance is disclosed in U.S. Pat. No. 4,090,444 to Stearns.

The Stearns anchoring means comprises a holding bar adapted for clamping a blanket end and adapted for insertion into a channel provided in a reel. FIG. 1 shows the Stearns holding bar clamping a blanket end and inserted into a reel channel, with the blanket being wrapped slightly more than three revolutions around the reel to tighten the blanket around the printing cylinder. This arrangement is discussed in column 5, lines 60–68 of the Stearns patent. Since the holding bar protrudes from the channel above the surrounding reel periphery, the blanket is subjected to a localized, relatively great tension in the areas immediately adjacent to and generally radially above the holding bar. The tension causes uneven compression of the blanket and thereby permanently mars and deforms the blanket in those areas. Although such deformities do not significantly affect the operating life of single use blankets, the deformities gravely affect the operating life of multiple use blankets, effectively prohibiting the use of a Stearns type holding bar with multiple use blankets.

Multiple use printing blankets are becoming increasingly and extensively used, especially in printing metal cans for containing beverages. Basically a multiple use blanket is a blanket that is several times longer than the circumference of its associated printing cylinder. For example, the blanket might be approximately sixty inches long and its associated printing cylinder might have a circumference of about eighteen inches. Initially the leading blanket edge is attached to a first reel within the printing cylinder, and the trailing edge is attached to a second reel within the printing cylinder. The second reel is then rotated several times to tighten a portion of the blanket about the printing cylinder, thereby winding a portion of the blanket several times around the second reel. When the blanket portion initially wrapped about the printing cylinder is worn, a fresh, unused blanket portion may be wrapped about the printing cylinder by rotating the first reel to wind the worn blanket portion therearound and by rotating the second reel to unwind part of the blanket portion therearound, whereby the outermost blanket layers wound about the second reel become the fresh, unused blanket portion wrapped about the printing cylinder. This process may be repeated until the entire blanket is worn.

Multiple use blankets are also used in so-called segmented printing cylinders wherein the cylinder is provided with several longitudinal recesses equiangularly spaced about the cylinder periphery, each recess having a pair of reel rods extending therealong and therewithin. The multiple use blanket is connected to the adjacentmost reel rods of adjacent recesses and is wrapped about the printing cylinder periphery between the adjacent recesses. The blanket is wound and unwound in much the same manner as described above, however, in this latter case, the multiple use blanket is several times longer than the printing cylinder periphery between adjacent recesses, rather than the entire printing cylinder periphery.

Since the time involved in winding a fresh blanket portion about the printing cylinder is much less than the time involved in replacing a blanket, one can readily appreciate that multiple use blankets are strongly preferred over single use blankets. One can also appreciate that use of a Stearns type holding bar with multiple use blankets creates deformities in blanket portions that are eventually wrapped about the printing cylinder. These blanket portions are effectively useless for printing since, as is well known in the printing art, even minute blanket thickness variations amounting to even fractional thousandths of an inch produce very large changes in the color or intensity of the printed image.

SUMMARY OF THE INVENTION

It is a feature of the present invention to provide a simple and economical printing blanket holding bar which is easily and quickly attached and detached relative to a so-called reel rod or reel associated with a printing cylinder of a printing press and which will not deleteriously affect the blanket operating life when the blanket is wrapped at least one revolution around the reel, such as when multiple use blankets are utilized.

Another feature of this invention is to provide a printing blanket holding bar wherein the holding bar comprises a base having a neck portion extending therefrom and a blanket clamping arm carried by the base neck portion, the arm being adapted to cooperate with the base to fix an associated end of a printing blanket therebetween, and the top surface of the arm being rounded.

Other details, features, objects, and advantages of this invention will become apparent from the following descriptions of representative embodiments, taken in conjunction with the figures of the accompanying drawings in which:

DESCRIPTION OF PREFERRED EMBODIMENTS

Figure 1:
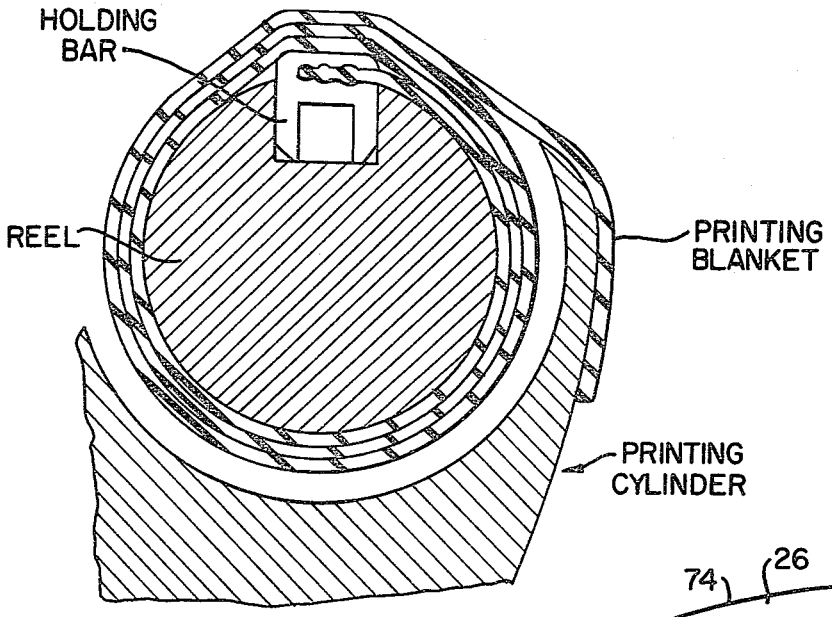
FIG. 1 (PRIOR ART)
FIG. 1 is a fragmentary cross-sectional end view of a portion of a printing cylinder employing a reel and a trailing end portion of a printing blanket anchored to the reel with a holding bar according to the disclosure of U.S. Pat. No. 4,090,444 to Stearns.

Reference has already been made to FIG. 1 in discussing the background of the present invention and the disadvantages attendant the printing blanket holding bar disclosed in U.S. Pat. No. 4,090,444 to Stearns. The present invention is an improvement of the basic printing blanket holding bar disclosed in the '444 patent.

Figure 3:
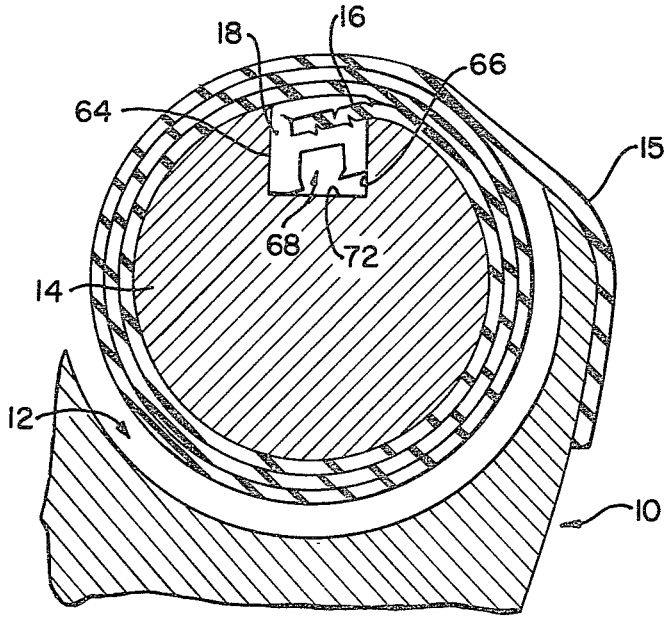
FIG. 3 is a fragmentary cross-sectional end view of a portion of a cylinder employing a reel and a trailing end portion of a printing blanket anchored to the reel with a holding bar according to the present invention.

There is shown in FIG. 3 a fragmentary portion of a printing cylinder 10 of the type commonly used in a printing press employed in offset or dry offset printing. The periphery of the printing cylinder 10 is provided with a longitudinally extending, substantially cylindrical recess 12, within which longitudinally extends at least one rotatable so-called reel rod, reel roller, or reel 14. A printing blanket 15 may be wrapped about the printing cylinder 10 by first securing a leading blanket end (not shown) to the printing cylinder 10 by any of a variety of means well known in the art, fixing the trailing blanket end 16 to the holding bar 18 of this invention, the properties of which will be described in detail subsequently, attaching the holding bar 18 to the reel 14, and then rotating the reel 14. Optionally, the leading blanket end may be secured to the printing cylinder 10 in the same manner as the trailing blanket end 16, through the utilization of a second reel and a second holding bar.

Figure 2:
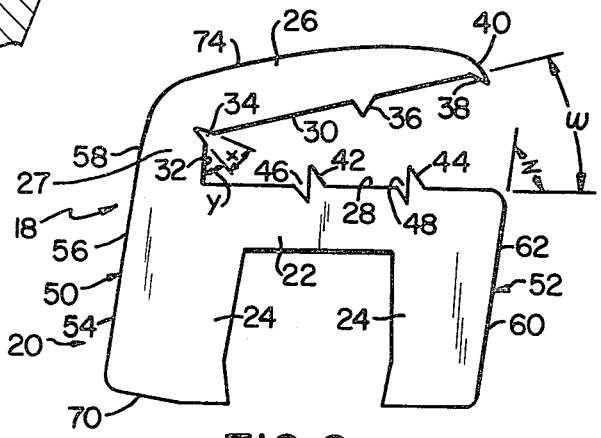
FIG. 2 is an end view of a holding bar according to the present invention.

Reference is now made to FIG. 2 of the drawings which shows the printing blanket holding bar 18 in an enlarged end view prior to fixation of the trailing blanket end 16 thereto. The holding bar 18 comprises a generally U-shaped base 20 having a bight 22 and a pair of spaced legs 24 depending from the bottom side and at opposite ends of the bight 22. The holding bar 18 also includes a blanket clamping arm 26 which is carried by and preferably is integral with a neck portion 27 of the base 20 extending upwardly above one of the legs 24. The arm 26 is particularly adapted to cooperate with the substantially flat top surface 28 of the bight 22 to fix an associated blanket end, such as the trailing blanket end 116, therebetween. In FIG. 2, the arm 26 is shown in a raised or unclamped position which facilitates placement of the blanket end between the arm 26 and the bight top surface 28 prior to forcing the arm 26 toward the bight top surface 28 to clamp the blanket end 16 therebetween.

The arm 26 has a substantially flat bottom surface 30 which lies at an angle W of preferably about sixteen degrees to the bight top surface 28 when the arm 26 is in an unclamped position, as shown in FIG. 2, and lies substantially parallel to the bight top surface 28 when the arm 26 is in a clamped position, as shown in FIG. 3. The region of the holding bar 18 where the arm bottom surface 30 joins the substantially flat inside surface 32 of the neck 27 is notched so that no substantial internal stresses are created in that region when the arm 26 is forced from an unclamped to a clamped position. The notch 34 is preferably "V" shaped, with the edges of the notch 34 defining an angle X of preferably about twenty degrees and the neck inside surface 32 defining an angle Y of preferably about forty-five degrees with the notch edge closest thereto.

The arm bottom surface 30 is provided with a plurality of projecting teeth 36, 38, one of which projects from the tip 40 of the arm 26. Similarly, the bight top surface 28 is provided with a set of projecting teeth 42, 44 and with a corresponding tooth-shaped recess 46, 48 disposed immediately adjacent to each tooth 42, 44.

The blanket end is clamped to the holding bar 18 by first coating the arm bottom surface 30, the neck inside surface 32, the bight top surface 28, and the blanket end with an adhesive or a cement. The blanket end is then inserted between the arm 26 and the bight 22 until the tip of the blanket end abuts the neck inside surface 32. Finally the arm 26 is forced into its clamped position in which the various projecting teeth 36, 38, 42, 44 bite into, but not through, the blanket end to grip the same securely. Additional gripping of the blanket end is provided by the cement bond between the blanket end and the surrounding holding bar surfaces, which bonding is augmented by hardened cement ridges extending into the tooth-shaped recesses 46, 48.

The holding bar base 20 has two substantially flat outside surfaces 50, 52 parallel with each other and facing in diametically opposite directions. One base outside surface 50 is defined by the outside surface 54 of one leg 24, the outside surface 56 of the end portion of the bight 22 disposed thereabove, and the outside surface 58 of the neck 27, and the second base outside surface 52 is defined by the outside surface 60 of the other leg 24 and the outside surface 62 of the other end portion of the bight 22 disposed thereabove. The second base outside surface 52 intersects the bight top surface 28 at an angle Z of approximately seventy-four and one-half degrees. The outside surfaces 50, 52 of the base 20 are adapted to be disposed against and between cooperating side surfaces 64, 66 of a channel 68 longitudinally extending along the reel 14. The holding bar 18 may be readily attached to the reel 14 by simply inserting the same into the channel 68 and may be readily detached from the reel 14 by simply retracting the same from within the channel 68, the fit between the base outside surfaces 50, 52 and the channel side surfaces 64, 66 being sufficiently close to create a frictional force inhibiting the totally free movement of the holding bar 18 within the channel 68.

The holding bar 18 and the channel 68 are designed so that the upper edge of the second base outside surface 52 lies even with the peripheral edge of its corresponding channel side surface 66. Such a design insures that the inner surface of the blanket end portion external of and adjacent to the holding bar 18 will rest against the periphery of the reel 14 adjacent to such channel side surface 66, thereby creating a condition that best promotes uniform tension and compression being applied to the blanket in that region.

It is a feature of the present invention that when the holding bar 18 is in the above-described position, the upper edge of the first base outside surface 50 also lies even with the peripheral edge of its corresponding channel side surface 64 and the bottom surface 70 of at least one leg 24 abuts the base 72 of the channel 68. Such positioning of the upper edge of the first base outside surface 50 forms a generally continuous surface between the adjacent reel periphery and the arm top surface 74, which allows the blanket, when wrapped at least approximately one revolution around the reel 14, to rest against the reel periphery adjacent to the corresponding channel side surface 64 and guarantees that the blanket will not abruptly contact the holding bar 18 in the area along said upper edge. Therefore such positioning also promotes the uniform compression of the blanket against the reel periphery and against the holding bar 18 and inhibits the marring or deforming of the blanket.

Such uniform compression is further promoted by another feature of the present invention wherein the arm tip tapers to virtually a negligible thickness, thereby providing a generally continuous surface between the arm tip and the outer surface of the blanket portion external of and immediately adjacent to the holding bar 18. This second feature also inhibits the marring or deforming of the blanket.

Yet another feature of the present invention is the provision of an outwardly rounded or bowed top surface 74 of the arm 26, which promotes the uniform compression of the blanket against the holding bar 18. Moreover, the bowed top surface 74 may be defined by an areuate portion of a circle having its center of curvature generally coincident with the center of curvature of the reel 14.

Any of the three above-recited features may be utilized alone or in combination with any of the other features. It should also be appreciated that the holding bar 18 of the present invention may be utilized with a reel having a boss instead of a channel, such as shown in FIG. 2 of the '444 patent.

Although particular embodiments of the present invention have been described and illustrated herein, it should be recognized that modifications and variations may reading occur to those skilled in the art and that such modifications and variations may be made without departing from the spirit and scope of my invention. Accordingly, all such modifications and variations are included in the scope of the invention as defined by the following claims:

I claim:

1. A printing blanket holding bar insertable in a generally rectangular axially disposed channel formed in a cylindrical blanket holding reel for anchoring one end of a printing blanket on the blanket holding reel, said bar comprising a generally U-shaped base member having a bight and a pair of legs extending from the opposite ends of said bight adapted to be slidably received within said channel with the outer surface of said legs being disposed in interfacial relation with the side walls of said axially disposed channel and with the upper surface of said bight being disposed in an increasing depth chordal relation relative to the surface of said blanket holding reel and an integral blanket clamping arm hingedly connected to the lower end of the bight portion of said base member, thereby forming a jaw opening toward a first side wall of the channel and adapted to cooperate with the upper surface of the bight portion of said base member to clamp an end portion of the printing blanket therebetween, the one of said legs adjacent said first channel sidewall forming an acute included angle with the upper surface of said bight and said second leg being parallel thereto, said clamping arm having an upper arcuate outer surface formed such that when the generally U-shaped base member of the printing blanket holding bar is inserted in the channel with said upper outer surface of said clamping arm lying across the channel, the marginal edge of said upper outer surface of said clamping arm is disposed in substantially flush continuous facing relation with the top edge of a second side wall of the channel, and wherein the upper surface of the bight remote from the hinged connection of said clamping arm is disposed in substantially flush continuous facing relation with a top edge of the first side wall of the channel.

2. A printing blanket holding bar according to claim 1 wherein the thickness of said blanket clamping arm progressively decreases across the channel toward the first side wall.

3. A printing blanket holding bar according to claim 1, wherein said blanket holding reel is substantially cylindrical and wherein the upper outer surface of said blanket clamping arm is defined by an arcuate portion of a circle having its center of curvature generally coincident with the center of curvature of said blanket holding reel.

* * * * *